United States Patent [19]

McCain et al.

[11] 4,174,829

[45] Nov. 20, 1979

[54] NEWSPAPER STUFFERS

[75] Inventors: William B. McCain, Hinsdale; James F. Cosgrove, Western Springs; Elmer Bewersdorf, Downers Grove, all of Ill.

[73] Assignee: McCain Manufacturing Corporation, Chicago, Ill.

[21] Appl. No.: 874,265

[22] Filed: Feb. 1, 1978

[51] Int. Cl.[2] ..... B65H 5/30
[52] U.S. Cl. ..... 270/55; 270/58
[58] Field of Search ..... 270/54-58

[56] References Cited

U.S. PATENT DOCUMENTS

| | | | |
|---|---|---|---|
| 3,953,017 | 4/1976 | Wise | 270/54 |
| 4,083,551 | 4/1978 | Denis | 270/55 |

*Primary Examiner*—Edgar S. Burr
*Assistant Examiner*—A. Heinz
*Attorney, Agent, or Firm*—Kinzer, Plyer, Dorn & McEachran

[57] ABSTRACT

If a newspaper jacket to be stuffed with a collection of inserts does not timely arrive at the stuffing station the inserts intended therefore are rejected but the machine is not stopped; if the inserts are detected as insufficient in number the ones which are present may be rejected and the jacket may also be rejected.

5 Claims, 7 Drawing Figures

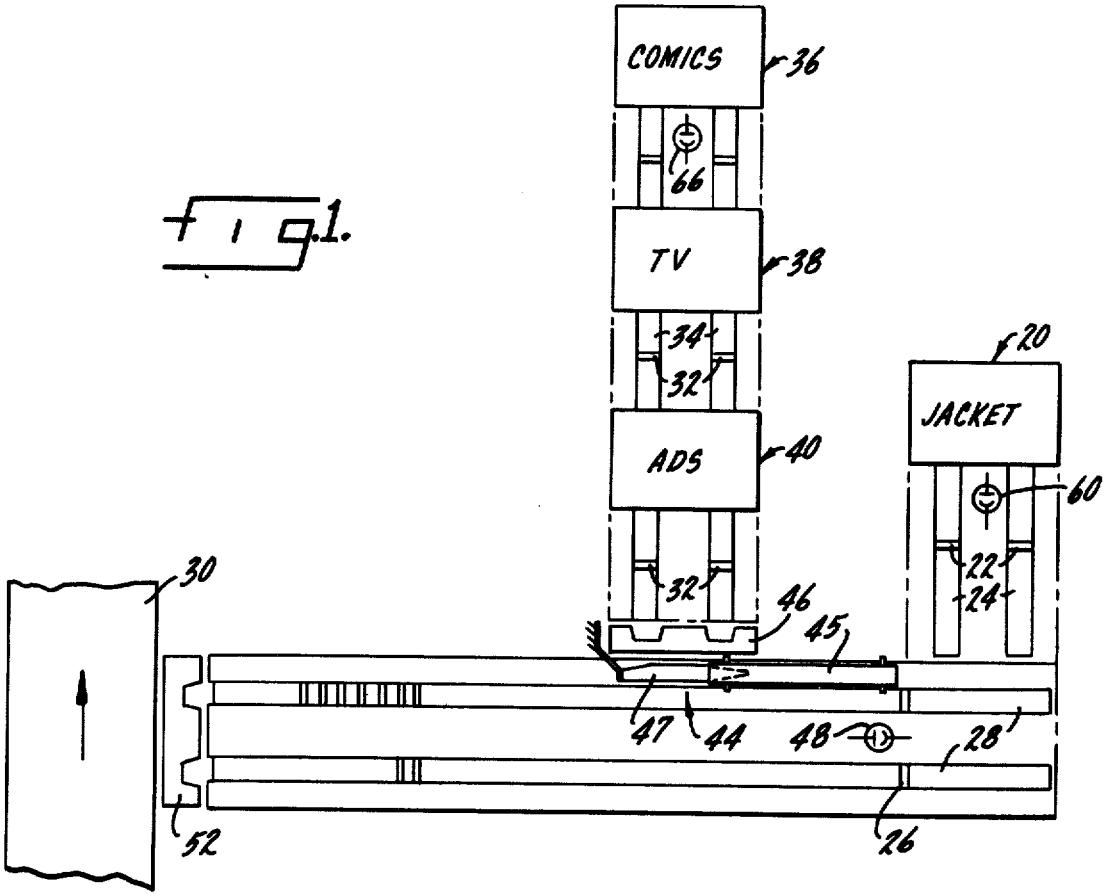
fig.1.
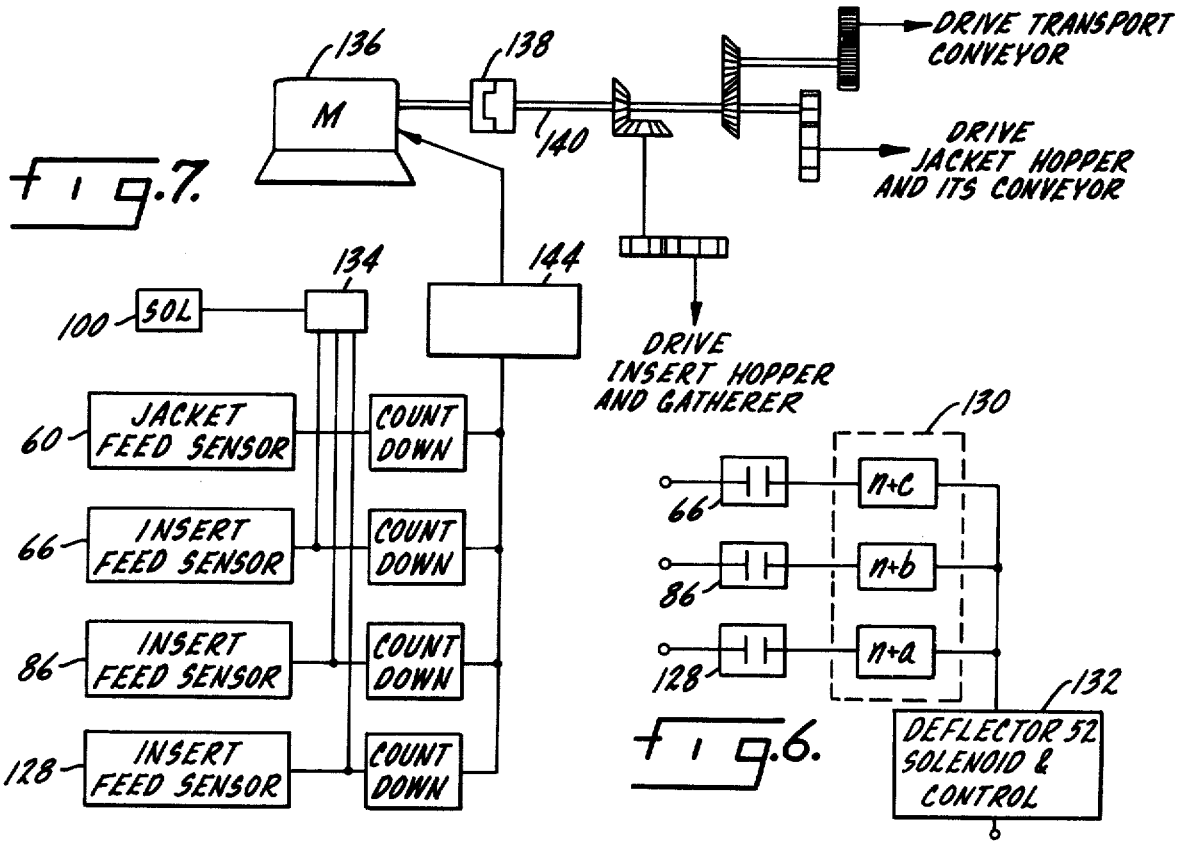
fig.7.
fig.6.

NEWSPAPER STUFFERS

This invention relates to a machine for stuffing a newspaper section with inserts.

The present machine is generally of a known construction in that a newspaper section to be stuffed is transported to a stuffing station where the section is opened to receive the insert material, the insert material comprising several individual inserts stacked one atop another on a gathering conveyor, having been fed to the gathering conveyor from a corresponding number of supply hoppers in which the individual inserts are stacked.

Thus the insert material may comprise a comic section, a TV guide, and perhaps weekend advertising by local discount stores. It is not possible always to assure that the newspaper section arrives at the stuffing station. Indeed it is common practice to employ a detector or sensor to determine if the newspaper section is being timely fed to the stuffing station and if the indication is in the negative then the customary practice has been to stop the machine. This may entail a great deal of down time resulting in diminished production. In accordance with the present invention, and constituting one of the objects thereof, the machine is not stopped in event of failure to detect a timely fed newspaper section, fed to the stuffing station; rather to the collected inserts are themselves rejected and the machine continues to run. In this manner, no down time is encountered, nor will there necessarily be a machine jam. In other words, the conveyor which transports the newspaper sections past the stuffing station will simply display a blank space.

There can also be failure to feed one of the inserts. Some newspaper publishers are willing to tolerate this situation, accepting a call from an irate customer and arranging for delivery of the missing material. However, in accordance with the present invention, and constituting another object thereof, provision is made for detecting failure to feed an insert item to the gathering conveyor and in that event a reject deflector is actuated to reject the remaining inserts while a second deflector is actuated to remove from the main stream the newspaper section.

More specifically, it is an object of the present invention to construct a machine in which both modes of operation are possible, that is, a mode of operation in which insert material, though complete, is rejected from participating in the main stream in the event a newspaper section is not at the stuffing section, while also removing from the main stream a newspaper section which will not be receiving the full quota of insert material.

IN THE DRAWING

FIG. 1 is a plan view of apparatus constructed in accordance with the present invention;

FIGS. 6 and 7 are diagrammatic views of certain control circuits.

Figure 2:
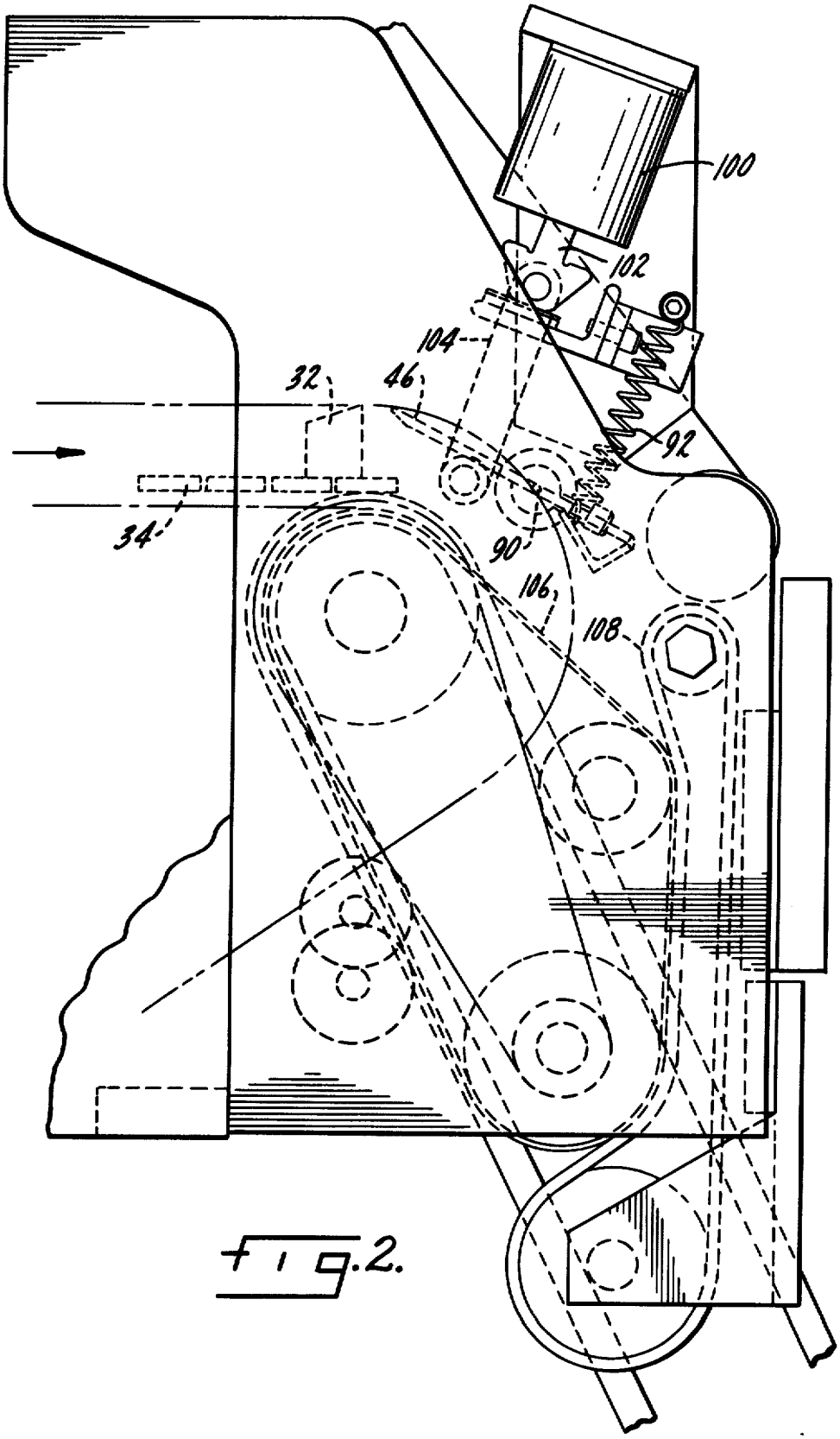
FIG. 2 is an elevational view showing means for rejecting collected inserts in accordance with the present invention.

The general plan of the machine is shown diagrammatically in FIG. 1. The newspaper sections or jackets are contained in a jacket supply hopper 20 and are extracted therefrom one by one, passing to an in-feed conveyor comprising upright, laterally spaced pusher fingers 22 carried on a corresponding pair of endless feed bands 24.

The in-feed conveyor delivers the newspaper sections to a lateral transport conveyor characterized by upright pusher fingers 26 carried by a corresponding pair of endless feed bands 28.

The transport conveyor moves the individual newspaper sections forwardly to a collecting station which is characterized by a take-off conveyor 30 having a path at right angles to that of the transport conveyor. The take-off conveyor may be driven in either direction.

The transport conveyor moves past a gathering conveyor characterized by upright pusher fingers 32 supported on a pair of parallel, endless feed bands 34.

The gathering conveyor is positioned beneath a plurality of supply hoppers 36, 38 and 40 in which are stacked the individual inserts to be stuffed. Supply hopper 36 may contain comics, supply hopper 38 may contain a TV guide and supply hopper 40 may contain local advertising.

As will be explained in more detail below the insert items, assumed to be three in number or order, are gathered one atop another and stuffed collectively into the newspaper section.

Stuffing takes place at a stuffing station 44 whereat is positioned means for opening the newspaper section. The means for opening the newspaper section is known and comprises a belt 45 which lifts the upper half of the newspaper jacket which is then held open by a shoe 47 as the jacket is being stuffed.

A reject deflector blade 46 is interposed between the gathering conveyor and the transport conveyor, positioned at the terminus of the gathering conveyor. Cooperating with the reject deflector blade is a detector for sensing the timely passage of a newspaper section into the stuffing station. This detector is in the form of a photocell 48 so positioned above the transport conveyor as to detect the timely arrival of a newspaper section at the stuffing station in the same machine cycle as the arrival of the insert material to be stuffed. Thus, if it is detected that there is no newspaper section to intercept the gathered insert material the deflector 46 is actuated so that the transport conveyor will not be inflicted with a collected group of inserts for which there is no receiving newspaper section.

A similar reject deflector blade 52 is interposed between the transport conveyor and the take-off conveyor. As will be explained in more detail below, the deflector blade 52 is actuated to reject the newspaper section determined as not containing the insert material.

Figure 3:
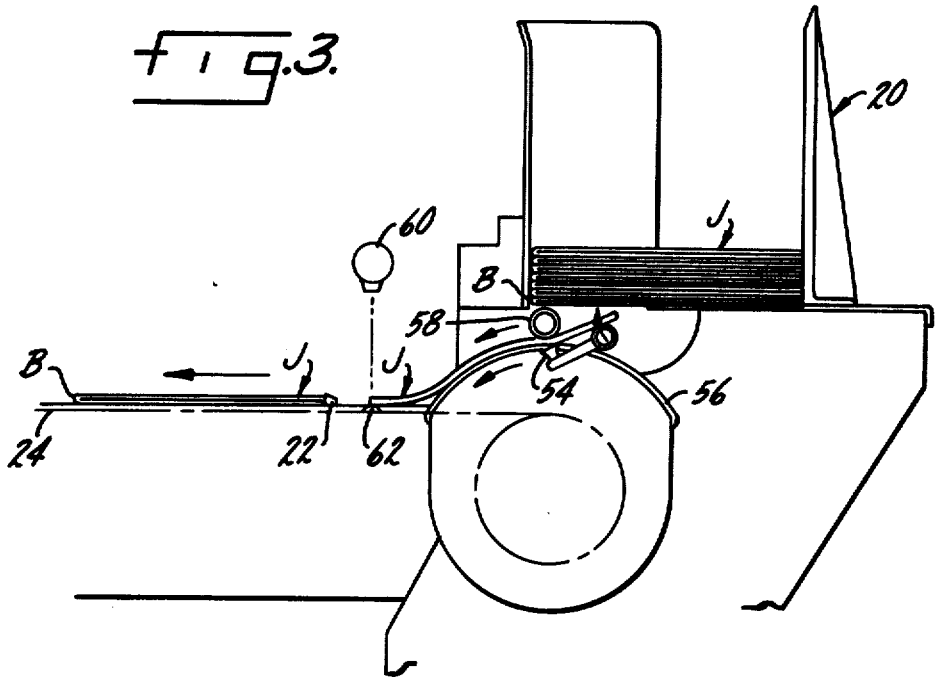
FIGS. 3 and 4 are elevational views showing, respectively, means for feeding the newspaper jacket and one of the inserts.

The in-feed mechanism associated with the supply hoppers 20 and 36 is identical and is shown in FIG. 3, assumed to be that for the hopper 20 employed for feeding the jackets. The supply of jackets J is represented by a flat stack. Positioned beneath the lowermost jacket are oscillating suction cups 54, effective to extract from the hopper 20 the lowermost jacket which, it will be noted, has the fold or backbone B in the leading position. The suction cups 54 pull the jacket downward toward a rotating segment 56 and concurrently driven squeeze rollers 58 (oscillating around the axis of rotation of the segment 56) are positioned to clamp the jacket onto the segment 56 moving the jacket onto the feed belts 24.

To detect the in-feeding of the jacket J, a photocell 60 is juxtaposed above conveyor 24 in position to scan a polished reflector 62. The photocell 60, as will be explained in more detail hereinafter, detects the passage of the jacket from the supply hopper to the in-feed conveyor and may advantageously be employed to detect a repeating malfunction in which event the machine may be stopped.

The feeder or delivery mechanism associated with hopper 36 is identical to that described above in connection with the jacket hopper 20 and as shown in FIG. 1 the photocell 66, similar to photocell 60, is positioned in front of supply hopper 36, juxtaposed above the conveyor belts 34, again for the purpose of detecting successive delivery of the inserts contained in supply hopper 36.

Figure 4:
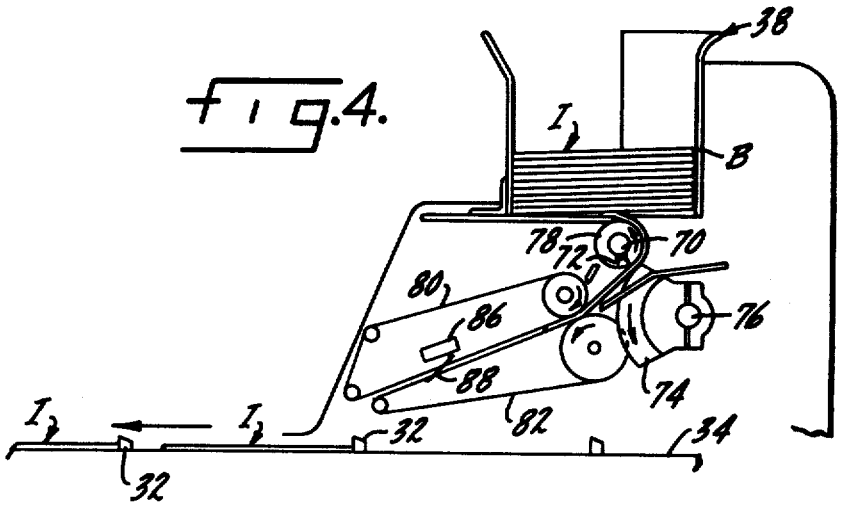

The feed mechanism for delivering inserts from supply hoppers 38 and 40 is identical and consequently the feed mechanism associated with supply hopper 38 alone is depicted, FIG. 4. In this instance, the inserts I are arranged in the supply hopper 38 with their backbones B in trailing position. Positioned beneath supply hopper 38 is a shaft 70 supporting a plurality of suction cups 72 effective, during repeated rotation of shaft 70, successively to extract the lowermost insert from hopper 38, inverting that insert and presenting it to a cooperating, opposed feeder segment 74 carried on a rotating shaft 76. It will be seen that the extracted insert is inverted so that its backbone is in leading position as it is advanced into the bight between the feeder segments 74 and opposed feeder rollers 78 supported on shaft 70 for rotation therewith.

The cooperating feeder segments 74 and the rollers 78 are effective to deliver the insert to feed belts 80 and 82 which cooperate to deliver the insert to the pusher fingers 32 carried by the gathering conveyor 34.

To detect delivery of an insert from supply hopper 38 (and from supply hopper 40 as well) a micro-switch 86 has its detector finger 88 in intercepting position between the in-feeding belts 80 and 82. The manner in which the micro-switches are functionally utilized will be described in more detail below.

In the event detector 48, FIG. 1, fails to detect the passage of a jacket in the cycle of the machine when the gathered insert would be stuffed into that jacket, the deflector blade 46 is actuated to the position shown in FIG. 2, to prevent delivery of the gathered inserts, compared to the deflector blade 46 being normally in a horizontal position supporting and guiding the gathered inserts for delivery into the stuffing station where the gathered inserts are intercepted by the opened jacket.

The deflector blade 46 is supported on a pivotal axis 90 and is biased to normal position by a spring 92.

To actuate the deflector against the return action spring 92, a solenoid 100 is employed having its armature 102 connected by a link 104 to the deflector 46.

When the solenoid 100 is energized, in a manner to be explained below, the insert deflector blade 46 is elevated to the position shown in FIG. 2, and the collected group of inserts is rejected. Thus, as shown in FIG. 2, driven belts 106 and opposed cords 108 are arranged beneath the deflector blade 46 to receive the rejected inserts, delivering these to a discard station which may be represented by a discard bin, not shown.

The jacket deflector 52 is similar in construction and operation to the deflector 46. However, deflector 52 when actuated, instead of directing the jacket downward to a collector bin may be employed in the reverse sense to deflect the rejected jacket upward to feeder tapes, not shown, which pass the rejected material upward and over the take-off conveyor 30.

Figure 5:
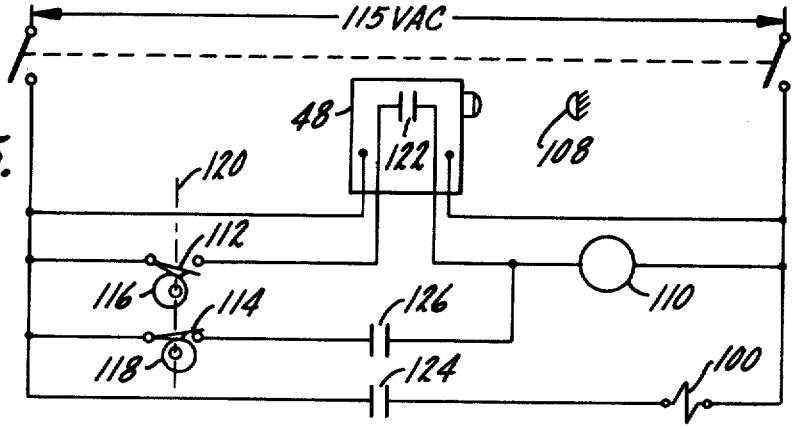
FIG. 5 is a wiring diagram.

The photocell detector 48 is employed to actuate solenoid 100 in the event a jacket to be stuffed is not timely fed to the stuffing station. A circuit for accomplishing this is shown in FIG. 5. Photocell 48, like photocell 60 is opposed to a polished reflector 108. The photocell is interposed in the circuit for energizing a relay 110.

Timing is accomplished by two cam-operated switches 112 and 114, timed by cams 116 and 118 on a timing shaft 120 synchronized to the machine cycle.

Switch 112 is in closed position when the newspaper jacket, if timely arriving at the stuffing station, covers the reflector 108 and no circuit is completed to the relay 110; if not, then the photocell, excited by the exposed reflector (no jacket) effectively completes the relay circuit at 122, energizing solenoid 100 through relay contacts 124 and also resulting in a holding circuit for the relay.

The holding circuit includes timing switch 114 and relay contacts 126; when switch 114 is opened by its cam 118 the circuit to relay 110 is broken, breaking the circuit (at 124) to solenoid 100. This breaking of the circuit is timed to occur after the insert material has been rejected so the solenoid circuit is restored to its normal inactive state for the next machine cycle when the following jacket should be approaching the stuffing station.

It has been mentioned deflector 52 is actuated in the event there is failure to feed one of the inserts and at the same time the other inserts, though fed from their hoppers, are rejected. However, the deflector 52 is displaced several machine cycles ("n" cycles) downstream of the stuffing station and is displaced from detector 66 by n+c cycles, from detector 86 by n+b cycles and from detector 128 associated with hopper 40 (see FIG. 6) by n+a cycles, where a, b and c are a function of the spacing of the pusher fingers on the conveyors. Accordingly it is necessary to store the information (no feed) derived from the respective insert detectors. In this connection it may be mentioned all the pusher fingers on the transport conveyor are on eighteen inch centers while the pusher fingers 22 and 32 are on fourteen inch centers, the rotary cycle of the machine being synchronized thereto.

Thus, as shown in FIG. 6 a shift register 130 is interposed between each of the insert detectors and the solenoid control 132 for deflector 52. This control 132 incorporates a relay, relay contacts and timing switches identical in function to those shown in FIG. 5; the only difference is that the mis-feed signal from the insert detector is delivered to its register (n+c or n+b or n+a) of the shift register where the signal is delayed for n+ cycles before being used in the circuit for the solenoid which actuates blade 52.

The shift register 130 is well known and may be programmed to emit a "jacket reject" signal in response to an insert detector switch failing to close at the proper time. A similar shift register 134, FIG. 7, may be employed to transmit an energizing signal to solenoid 100 at the appropriate time when there is failure to feed an insert which should be fed. It will be seen from the foregoing that when there is failure to feed an insert which should be fed both reject plates or gates 46 and 52 are operated.

The detectors 60, 66, 86 and 128 may also be used to sense a malfunction, deemed to be a repeated number of cycles in which delivery from the corresponding supply hopper is not detected.

As shown in FIG. 7, the main drive for the machine is a motor 136 having its output coupled by a clutch 138 to a drive shaft 140 employed to drive gears for both the jacket feeder and the insert feeders.

The motor is adapted to be disabled by a start-stop circuit 144, in turn controlled by a signal from any one of the four re-set counters coupled to the detector contacts 60, 66, 86 and 128. One or two failures to feed is not necessarily a malfunction and only results in rejection of the gathered inserts as already explained. However, repeated failure to feed represented by a countdown of three or more successive cycles is deemed a malfunction resulting in a signal to disable the machine drive to allow inspection of the defective feeder.

It will be seen from the foregoing that one deflector is employed to reject an insert when the jacket is missing while a second deflector is employed to reject the jacket when there is a missing insert. There may be times when only one insert is fed, that is, some of the hoppers are idled. From this it will be realized that the principle may also be applied to those machines in which inserts, instead of being gathered one atop another on a common gatherer, may be fed into the open jacket at successive stuffing stations, that is, successively from hoppers at the side of the main stream, each feeding an insert into the jacket.

We claim:

1. In a newspaper stuffing machine where a newspaper section is opened at a stuffing station so it may be stuffed with insert material, the newspaper being fed from a jacket supply hopper to a transport conveyor moving past the stuffing station which is located in front of a gathering conveyor on which is gathered the insert material to be stuffed, and in which the insert material may be composed of a number of individuual inserts fed to the gathering conveyor from a corresponding number of insert supply hoppers disposed in feeding relation to the gathering conveyor:

means to feed the newspaper sections one by one from the jacket supply hopper to the transport conveyor;

a detector to detect failure to feed a newspaper section timely to the stuffing station;

a reject deflector positioned at the stuffing station normally to support and guide the gathered insert material for delivery into the opened newspaper section and when actuated serving to guide the gathered insert material into a discard station;

and means to actuate the reject deflector in the event of failure to detect a timely fed newspaper section thereby to prevent delivery of the insert material intended for the missing newspaper section.

2. A machine according to claim 1 wherein the transport conveyor delivers the stuffed newspaper section to a collecting station, detectors to detect the delivery of each insert to the gathering conveyor, a second reject deflector interposed between the transport conveyor and the collecting station, and means to actuate the second reject deflector when the insert material is insufficient in number, thereby to reject the corresponding newspaper section.

3. A machine according to claim 2 in which the deflector to reject the inserts and the second deflector to reject the newspaper section are each in the form of a guide plate spring biased to normal position respectively to guide the inserts to the stuffing station and to guide the newspaper section to the collecting station, a first solenoid which when energized actuates the first-named deflector to reject the inserts, a second solenoid which when energized actuates the second-named deflector to reject the newspaper section, a circuit to energize the first solenoid upon failure of a newspaper section timely to arrive at the stuffing station, and a circuit to energize the second solenoid when there is failure to detect delivery of an insert to the gathering conveyor.

4. A machine according to claim 1 in which the reject deflector is a pivotally mounted guide plate spring biased to normal position to guide the gathered inserts to the stuffing station, a solenoid connected to the plate to actuate the plate to reject position, and a circuit controlled by the detector to energize the solenoid.

5. A machine according to claim 1 including means to detect failure to feed an insert from a hopper and means to reject the newspaper section downstream of the stuffing station.

* * * * *